US007937872B1

(12) United States Patent
Fluhr

(10) Patent No.: US 7,937,872 B1
(45) Date of Patent: May 10, 2011

(54) PLASTIC MAGAZINES FOR USE WITH FIREARMS

(75) Inventor: Norbert Fluhr, Oberndorf (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 139 days.

(21) Appl. No.: 12/283,519

(22) Filed: Sep. 12, 2008

Related U.S. Application Data

(63) Continuation of application No. PCT/EP2007/002020, filed on Mar. 8, 2007.

(30) Foreign Application Priority Data

Mar. 10, 2006 (DE) ..... 10 2006 011 278

(51) Int. Cl.
*F41A 9/64* (2006.01)

(52) U.S. Cl. ..... 42/50

(58) Field of Classification Search ..... 42/49.01, 42/49.02, 50
See application file for complete search history.

(56) References Cited

U.S. PATENT DOCUMENTS

| | | | | |
|---|---|---|---|---|
| 2,712,705 | A | 7/1955 | St. Amant | |
| 2,745,203 | A | 5/1956 | Ruple | |
| 3,383,790 | A | 5/1968 | Into | |
| 3,453,762 | A * | 7/1969 | Fremont | 42/50 |
| 3,732,643 | A | 5/1973 | Wells | |
| 4,391,055 | A * | 7/1983 | Kadim | 42/50 |
| 4,539,889 | A * | 9/1985 | Glock | 89/147 |
| 5,168,648 | A * | 12/1992 | Brandl et al. | 42/50 |
| 5,461,811 | A | 10/1995 | Ciener | |
| 5,566,487 | A * | 10/1996 | Vaid et al. | 42/7 |

FOREIGN PATENT DOCUMENTS

| | | |
|---|---|---|
| AT | 35539 | 12/1908 |
| EP | 0154356 | 9/1985 |
| GB | 831218 | 3/1960 |

OTHER PUBLICATIONS

International Searching Authority, "International Search Report", for counterpart PCT application Serial No. PCT/EP2007/002020, mailed Jul. 4, 2007 (6 pages).
International Searching Authority, "Written Report of the International Preliminary Examination Report", for counterpart PCT application Serial No. PCT/EP2007/002020, mailed Jul. 4, 2007 (5 pages with 3 page translation).
International Searching Authority, "International Preliminary Report on Patentability", for counterpart PCT application Serial No. PCT/EP2007/002020, mailed Mar. 20, 2008 (5 page with 3 page translation).

* cited by examiner

*Primary Examiner* — Bret Hayes
(74) *Attorney, Agent, or Firm* — Hanley, Flight and Zimmerman, LLC

(57) ABSTRACT

Plastic magazines for use with firearms are described. An example plastic magazine for use with firearms includes a plurality of sidewalls along which cartridges are to be moved during a reloading of a firearm. Each of the plurality of sidewalls comprises a plastic material. Additionally, the example plastic magazine includes a metal coating adjacent a first surface of a first sidewall of the plurality of sidewalls, wherein the interior surface of the first sidewall is in a direction of fire.

7 Claims, 4 Drawing Sheets

PLASTIC MAGAZINES FOR USE WITH FIREARMS

RELATED APPLICATION

This patent is a continuation of International Patent Application Serial No. PCT/EP2007/002020, filed Mar. 8, 2007, which claims priority to German Patent Application 10 2006 011 278.4, filed on Mar. 10, 2006, both of which are hereby incorporated herein by reference in their entireties.

FIELD OF THE DISCLOSURE

This patent relates generally to plastic magazines and, more specifically, to plastic magazines for use with firearms.

BACKGROUND

Different styles and types of magazines are used with various types of firearms. Typically, all magazines include sidewalls that guide the cartridges as well as prevent the cartridges from falling out of the magazine. Some magazines such as box magazines and drum magazines have been made of plastic. However, other types of magazines, such as pan magazines that may be used in connection with Lewis machine guns, may also be made of plastic.

In recent years, plastic magazines have become popular for use with semiautomatic rifles, in part, because of their favorable price and high reliability. Prior to the rise in popularity of plastic magazines, sheet metal magazines were commonly used. However, as a result of an impact, sheet metal magazines have a tendency to dent, which may not be readily detectable to marksmen and, thus, the marksmen may not identify this defect. In contrast to sheet metal magazines, instead of denting from an impact, the elasticity of plastic enables most dents to pop out of plastic magazines and, thus, the plastic magazine is again in its substantially original form. Alternatively, plastic magazines may break from an impact, which makes the defect readily apparent to the marksmen.

In some example plastic magazines, such as described in EP 0 154 356 A2, an intermediate layer is injected into and/or added onto an upper part of sidewalls to strengthen the lip of the magazine and to ensure that the size of the lip corresponds to a slot of a receiver of the firearm. In other examples, such as described in U.S. Pat. No. 3,383,790, a piece of sheet metal forms a lip of a magazine by coupling the sheet metal to the top of the magazine's body.

Some difficulties were encountered when plastic magazines were initially experimented on for use with, for example, the 1947 Kalashnikov rifle, because sand or other derby would enter and jam the feed mechanism and the cartridges within the magazine. However, modern plastic magazines eliminate at least some of the problems encountered during these early experiments with plastic magazines. Modem plastic magazines are in fact as reliable as sheet metal magazines, but, in some instances, are firmer, lighter and more moldable.

Some firearms are configured to use 7.62×51 mm cartridges (e.g., a NATO round) that are each slightly tapered and, thus, the front edge of a stack of these cartridges is also tapered. Some magazines used with NATO rounds are curved. However, sheet metal magazines have straight sides because curved sheet metal magazines are significantly more expensive to produce and may pose issues associated with production defects. In contrast, curved plastic magazines may be produced for use with NATO rounds that are more reliable and less expensive to manufacture.

Some rifles such as, older rifles, were manufactured solely for use with sheet metal magazines. However, in recent years, attempts have been made to manufacture plastic magazines for use with these rifles. In developing plastic magazines, the dimensions of the corresponding sheet metal magazines have to be kept in mind. However, because of the material properties of plastic, the walls of plastic magazines are relatively thicker than the walls of sheet metal magazines. While the relatively thicker walls of plastic magazines do not effect a staggered zigzag arrangement of cartridges within the magazine, the relatively thicker walls do increase the plastic magazine's width. In particular, the plastic magazine's width is associated with the thickness of the walls and the necessary space between a tip of a cartridge and the front side of the magazine. The space between a tip of a cartridge and the front side of the magazine substantially prevents the cartridges from jamming. The size difference between plastic magazines and sheet metal magazines leads to incompatibilities between plastic magazines and rifles manufactured solely for use with sheet metal magazines.

One such rifle is the G3 rifle, which began production in the 1950's. As with all firearms manufactured during this era, the G3 rifle was manufactured for use with sheet metal magazines, as plastic magazines were not a feasible production option at the time. As such, the dimensions of the slot of the receiver of the G3 rifle corresponds to the dimensions of a sheet metal magazine and not the dimensions of a plastic magazine, even though both the sheet metal magazine and the plastic magazine are sized to hold the same size cartridge (e.g., NATO cartridges). While the G3 rifle began production decades ago, the G3 rifle, as with other such rifles, is still widely used throughout the world. Therefore, there is a demand by owners' (e.g., armies that use these rifles) of these rifles to update or replace components on their rifles such as, for example, replacing sheet metal magazines with more cost efficient and reliable plastic magazines. However, while there is a demand for replacement plastic magazines, plastic magazines are thicker and the dimensions of the magazine receiver in the weapon does not change, so there is less room in the magazine for conventional NATO rounds. While known plastic magazines may be configured to hold smaller rounds, which would enable the size of known plastic magazines to be compatible with a G3 rifle, it is extremely unlikely that an army affiliated with NATO supplies would agree to use cartridges that are, for example, a half millimeter shorter than a NATO round (e.g., not a NATO round).

DETAILED DESCRIPTION

Figure 1:
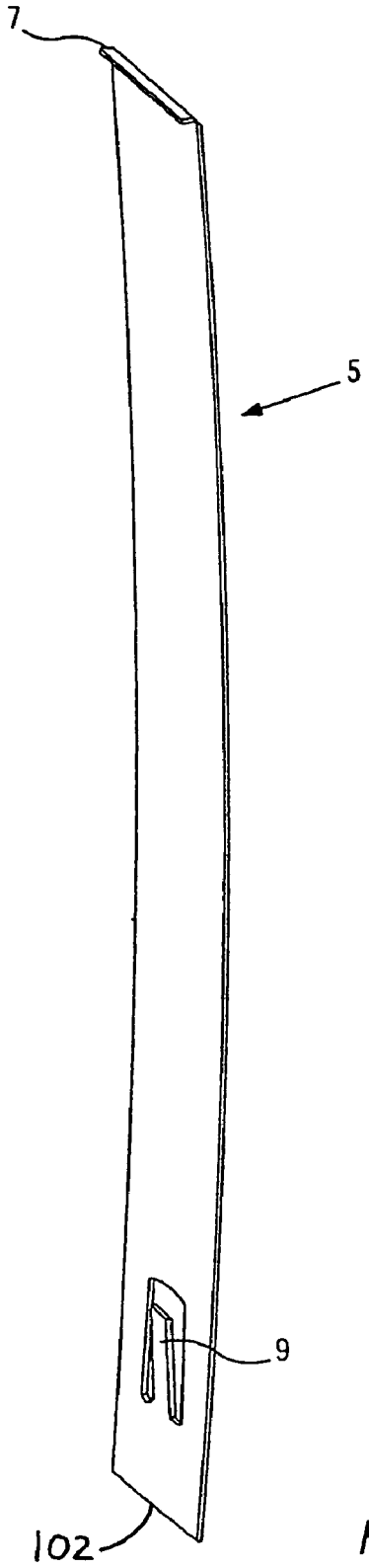
FIG. 1 depicts a plate to protect a first sidewall of an example magazine for use with firearms.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis. In some examples, a magazine is attached substantially vertically into a slot on the bottom of the firearm. However, in other examples, the magazine may be in a different position relative to the firearm such as, for example, the Bren machine gun in which a magazine is attached substantially vertically into a slot on the top of the firearm or the Sten submachine gun in which a magazine is attached substantially horizontally into a slot on the side of the firearm.

The methods and apparatus described herein are associated with magazines (e.g., box magazines) for use with firearms such as rifles (e.g., obsolete rifles) that substantially eliminates problems encountered with known plastic magazines. In particular, the methods and apparatus described herein are associated with plastic magazines for use with rifles that were manufactured for use with sheet metal magazines. As described above, due to the material properties of plastic, plastic magazines have thicker walls than sheet metal magazines that are configured to hold the same size cartridges (e.g., NATO cartridges, 7.62×51 mm cartridges) and, thus, there is less space between the tip of the cartridge and the front side of the magazine. To compensate for the thicker walls, known plastic magazines typically maximize the effective internal dimensions of the magazine to maintain an adequate distance between the tip of the cartridge and the front side of the magazine. In stark contrast to known plastic magazines, the methods and apparatus described herein actually decrease the effective internal dimensions of the plastic magazine by inserting a plate within a chamber into which the cartridges are positioned. Surprisingly, while the example methods and apparatus decrease the effective internal dimensions of the plastic magazine, the methods and apparatus described herein eliminate issues encountered with known plastic magazines and are compatible with rifles manufactured for use with sheet metal magazines. Specifically, the example methods and apparatus described herein substantially prevent cartridges from carving grooves within a front face of plastic magazines as the cartridges move within the magazine. If the grooves were to form, the cartridges may become jammed and/or the firearm may malfunction.

In some examples, the plastic magazines have a plurality of sidewalls along which cartridges move while the firearm is reloading. At least one of the sidewalls has a metal coating that faces the cartridges positioned within the magazine.

Figure 3:
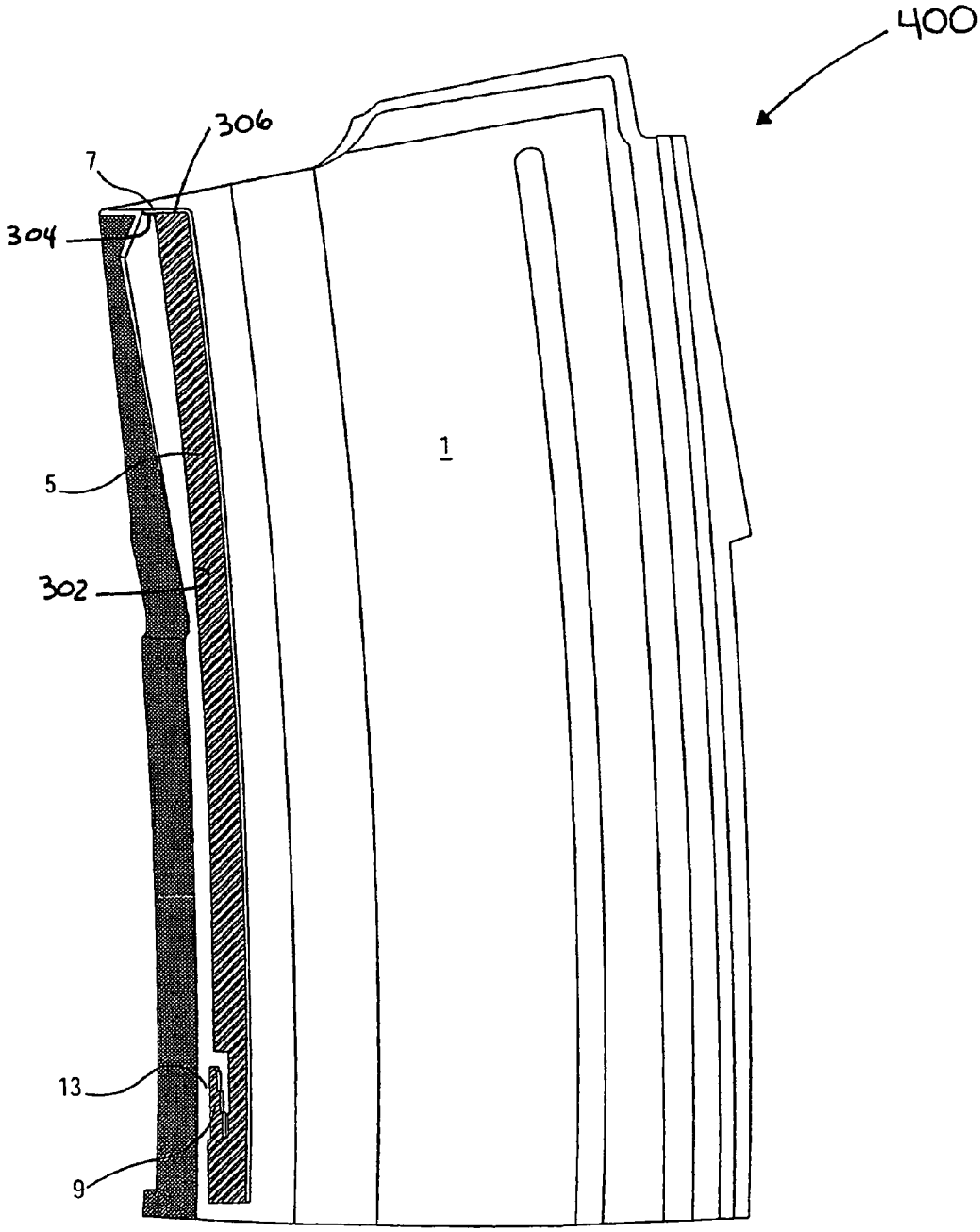
FIG. 3 depicts a partial cross-sectional side view of the example magazine and the plate positioned adjacent the first sidewall of the magazine.
Figure 4:
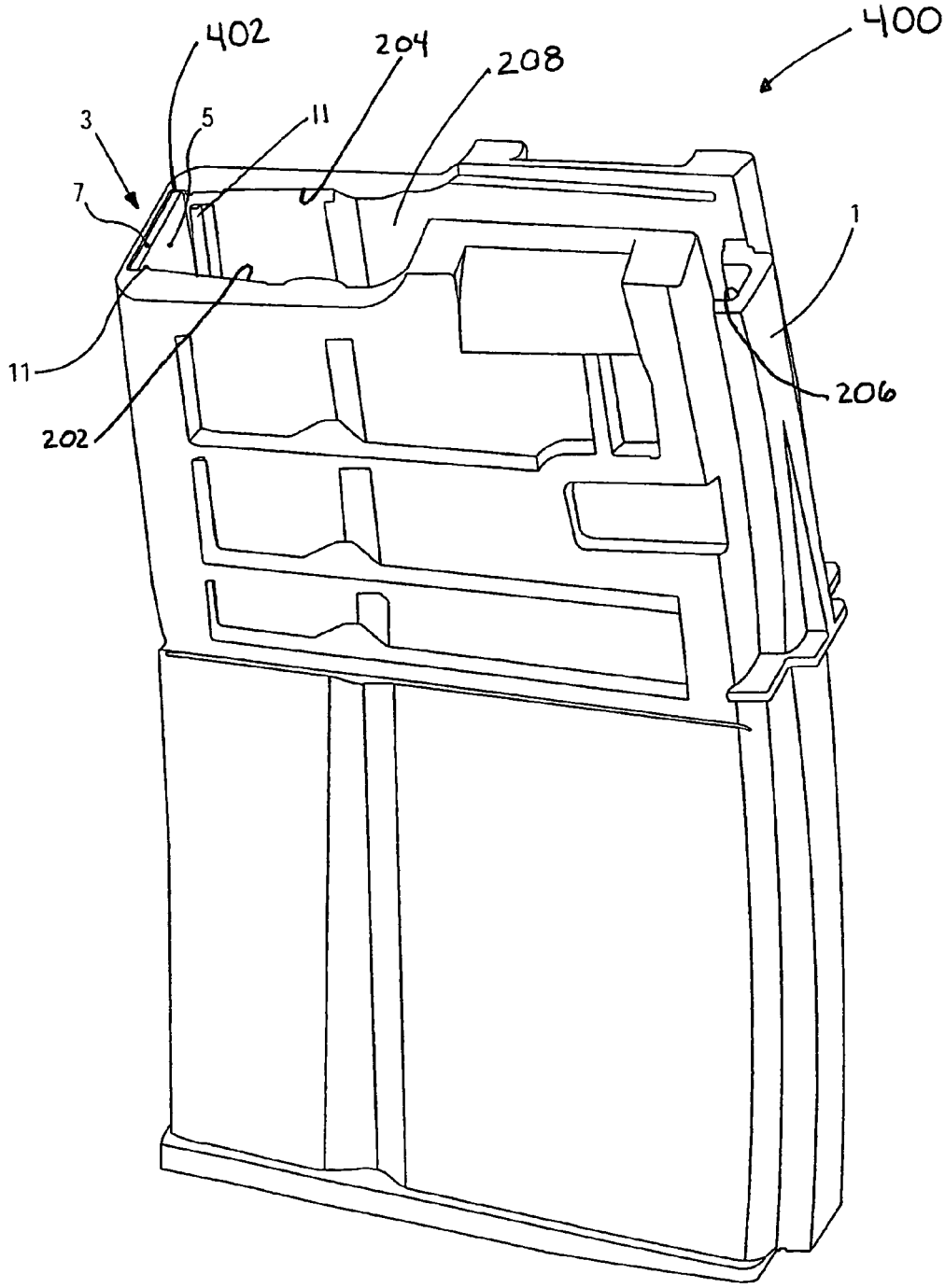
FIG. 4 depicts another view of the example magazine.

Turning initially to FIG. 4, FIG. 4 depicts a plastic magazine 400 (e.g., a plastic box magazine) having a body 1 (e.g., a plastic body) that is provided with a plurality of ribs 11 (e.g., a first rib and a second rib) and a groove 402 that corresponds to a plate 5. In practice, the plate 5 (e.g., a metal plate, a leaf spring, a steel spring sheet metal plate) is positioned within the groove 402 and is substantially parallel to a first surface 302 (FIG. 3) of a front wall 3 (e.g., a first sidewall) of the plastic magazine 400. The plate 5 has a lip 7 that at least partially covers and protects a second surface 304 (FIG. 3) on an end 306 (FIG. 3) of the front wall 3 that, in some examples, is substantially perpendicular to the first surface 302 (FIG. 3). The lip 7 is best depicted in FIG. 1.

Figure 2:
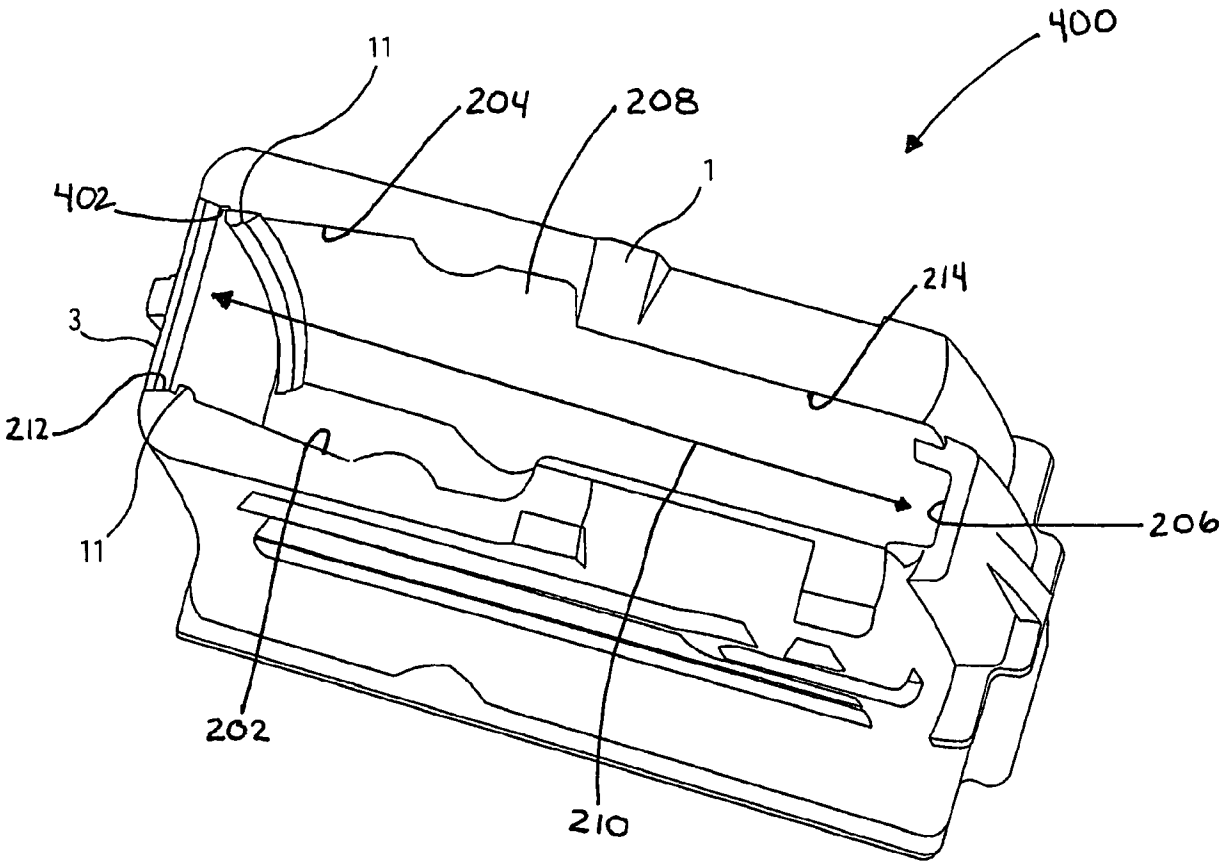
FIG. 2 depicts a top view of the example magazine.

Turning to FIG. 2, the plurality of ribs 11 are positioned on interior surfaces 202 and 204 of the body 1. The plate 5 is inserted from above into the groove 402 defined by the body 1 between the plurality of ribs 11 and the first surface 302 (FIG. 3) of the front wall 3.

Turning to FIG. 1, a clip 9 (e.g., a spring strip) is defined by the plate 5 adjacent an end 102 of the plate 5. Specifically, the clip 9 is manufactured by removing a piece of metal (not shown) bordering the clip 9 from the plate 5 and the clip 9 is then bent such that the clip 9 is positioned towards the first face 302 once the plate 5 is positioned within the body 1. The angle of the bend of the clip 9 transitions into the plate 5 adjacent the end 102.

Turning to FIG. 3, in practice, to assembly the plastic magazine 400, the plate 5 is inserted into the groove 402 of the body 1, which at least partially deforms the clip 9 to be substantially flush with the plate 5. Once the clip 9 is adjacent a recess 13 defined by the body 1, the clip 9 expands within the recess 13 toward the first surface 302 to position (e.g., substantially lock) the plate 5 within the body 1. The spring (not shown) and the feeding mechanism (not shown) may then be installed into the body 1 of the plastic magazine 400.

At least the first surface 320 of the front wall 3 is covered with a metal coatings and/or the plate 5. However, in other examples, the interior surfaces 202 and/or 204 and/or an interior surface 206 may also be provided with a metal coating and/or plate (not shown) that is substantially similar to the plate 5.

The insertion of the plate 5 into the groove 402 actually decreases the size and/or volume of a chamber 208 into which the cartridges are positioned. The methods and apparatus described herein are different from any known plastic magazines, because the problems associated with cartridges jamming within known plastic magazines are attributed to an available internal length 210 being sufficient to hold a particular size cartridge while maintaining a space between a tip of a cartridge and the front wall 3. Following this logic, decreasing the available internal length 210 by inserting the plate 5 into the chamber 208 should only magnify the frequency with which cartridges jam within the magazine. However, surprisingly, while inserting the plate 5 decreases the available internal length 210 of the chamber 208 it also eliminates malfunctions associated with known plastic magazines. This unexpected phenomenon has been corroborated by tests and studies. The tests and studies have indicated that firing a firearm causes cartridges within the plastic magazine 400 to move, which as a result of the available internal length 210, causes tips (not shown) of the cartridges to engage a surface 308 of the plate 5. The hardness and/or resilience of the plate 5 prevent the tips of the cartridges from carving grooves within the front wall 3. These grooves may be associated with cartridges jamming within known plastic magazines.

In some examples, the interior surfaces 202, 204 and 206 and the first surface 302 are all provided with a plate and/or a metal coating. However, preferably, the first surface 302 of the front wall 3 (e.g., the sidewall facing the direction of fire) is the only sidewall that is covered with a plate and/or metal coating and, thus, the plate 5 may be relatively thicker and more effective than if the interior surface 206 was also provided with a plate and/or a metal coating. In practice, pointed military projectiles (e.g., NATO rounds or other size cartridges) primarily damage the front wall 3 of plastic magazines and, therefore, providing the plastic magazine 400 with the plate 5 that only covers the front wall 3 prevents a majority of the damage attributed to these projectiles.

In some examples, the first surface 302 may be coated using electrochemical means. However, preferably, the first surface 302 is covered by the plate 5. In some examples, the plate 5 may be manufactured, processed and/or fabricated separately from the plastic magazine 400. The plate 5 may be hardened, bonderized and/or phosphated, which are processes that are often not possible using electrochemical applications. Additionally, the plate 5 may be made of a particularly well suited alloy(s) that may not be applied or whose application may be problematic using electrochemical processes.

In some example implementations, the plate 5 may comprise a steel material, a sheet metal material, a leaf spring or any other suitable material. In other examples, the plate 5 may comprise an iron-carbon mixture that cannot be electrochemically applied. However, preferably, the plate 5 may comprise a thin steel plate because of its ability to absorb impacts without marking and its resilience to enable the plate 5 to spring back to its substantially original form after a force applied by, for example, a cartridge, is removed.

In some example implementations, the plate 5 may be glued and/or coupled to the first surface 302 by any suitable means. However, preferably, the plastic magazine 400 is provided with the plurality of ribs 11 and the groove 402 into which the plate 5 is inserted. The plurality of ribs 11 may be constructed and/or formed on the interior surfaces 202 and 204 because the plurality of ribs 11 do not substantially interfere with and/or impede the movement of the cartridges within the plastic magazine 400. Specifically, the plurality of ribs 11 may be constructed on the interior surfaces 202 and 204 because a cross-section of the plastic magazine 400 (e.g., a plastic box magazine) is substantially rectangular and the cartridges have a slightly tapered tip. Additionally, the flexibility and/or resilience of the plate 5 enables the plate 5 to be effortlessly inserted into the groove 402 even if the front wall 3 is curved as is the case with some magazines that are configured for use with rimmed cartridges or cartridges with tapered casings.

In other example implementations, the plate 5 may be pressed into the groove 402 from the inside of the chamber 208. However, pressing the plate 5 into the groove 402 may be difficult because the plastic magazine 400 is extruded as a single piece. As depicted by FIGS. 2 and 4, the groove 402 has an opening 212 that is adjacent an opening 214 of the chamber 208. The openings 212 and 214 enable the plate 5 to be inserted through the openings 212 and 214 and into the groove 402 (e.g., on the top side of a conventional box magazine).

In other examples, the plate 5 is coupled to the first surface 302 by a fastener and/or a rivet. However, in the example depicted by FIG. 3, the front wall 3 defines the recess 13 that corresponds to the clip 9 of the plate 5. The engagement between the clip 9 and the recess 13 substantially prevents the plate 5 from accidently being removed and/or falling out of the plastic magazine 400. Specifically, the engagement between the clip 9 and the recess 13 positions, secures and/or locks the plate 5 within the groove 402. To properly position the clip 9 relative to the recess 13, the plate 5 is inserted into the groove 402 until the clip 9 is adjacent to and expands into the recess 13. Once the clip 9 engages the recess 13, the clip 9 and recess 13 substantially form a single part and/or unit as if they were permanently coupled to one another.

In some examples, the plate 5 does not include the lip 7. However, preferably, the plate 5 has the lip 7 to cover and/or protect the second surface 304 of the front wall 3. As a result, the front wall 3 may be thinner than would be possible without the presence of the plate 5. Additionally, a curvature and/or resilience of the plate 5 at least partially aids the feed mechanism in delivering the cartridges to the firearm.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A detachable plastic magazine for use with firearms, the detachable plastic magazine comprising:

a plastic housing having a substantially rectangular portion to be received by a firearm, the plastic housing comprising two sidewalls, a front wall, and a rear wall along which cartridges are to be moved during a reloading of a firearm, the two sidewalls, the front wall, the rear wall, and a bottom define an internal chamber to receive cartridges for firing by the firearm;

a first rib formed on an inside of a first of the two sidewalls, wherein the first rib is proximate the front wall and substantially parallel to the front wall;

a second rib formed on an inside of a second of the two sidewalls, wherein the second rib is proximate and substantially parallel to the front wall, wherein the first rib and the second rib are each substantially a same distance from the front wall; and a metallic reinforcement sized to cover at least a portion of the inside of the front wall, the metallic reinforcement being positioned to face tips of cartridges to be positioned within the internal chamber, wherein the metallic reinforcement is substantially planar and includes a lip disposed thereon that overhangs a top portion of the front wall, the metallic reinforcement further including a clip formed therein, the clip engages a recess on the inside of the front wall to retain the metallic reinforcement with respect to the plastic housing.

2. The detachable plastic magazine as defined in claim 1, wherein an engagement between the clip and the recess substantially secures the metallic reinforcement relative to the plastic housing.

3. The detachable plastic magazine as defined in claim 1, wherein the metallic reinforcement comprises a plate that is inserted into a groove positioned between the inside of the front wall and the first and second ribs.

4. The detachable plastic magazine as defined in claim 1, wherein firearms comprise rifles that were manufactured for use with sheet metal magazines.

5. The detachable plastic magazine as defined in claim 1, wherein the detachable plastic magazine comprises a detachable box plastic magazine.

6. A detachable plastic magazine as defined in claim 1, further comprising a groove positioned between the inside of the front wall and the first and second ribs, wherein the groove has an opening to enable the metallic reinforcement to be inserted into the groove.

7. A detachable plastic magazine as defined in claim 1, wherein the metallic reinforcement comprises at least one of a metal plate, a sheet metal plate, a leaf spring, or a steel spring sheet metal plate.

* * * * *